US009180070B2

(12) United States Patent
Carrel et al.

(10) Patent No.: US 9,180,070 B2
(45) Date of Patent: Nov. 10, 2015

(54) ADAPTOR FOR COUPLING TO A MEDICAL CONTAINER

(71) Applicant: Becton Dickinson Holdings Pte. Ltd., Singapore (SG)

(72) Inventors: Franck Carrel, Le Pont de Claix (FR); Lionel Maritan, Pierre-Chatel (FR); Frederic Perot, Saint Paul de Varces (FR)

(73) Assignee: Becton Dickinson Holdings Pte. Ltd., Singapore (SG)

( * ) Notice: Subject to any disclaimer, the term of this patent is extended or adjusted under 35 U.S.C. 154(b) by 0 days.

(21) Appl. No.: 14/375,173

(22) PCT Filed: Feb. 1, 2013

(86) PCT No.: PCT/SG2013/000045
§ 371 (c)(1),
(2) Date: Jul. 29, 2014

(87) PCT Pub. No.: WO2013/115731
PCT Pub. Date: Aug. 8, 2013

(65) Prior Publication Data

US 2015/0013810 A1 Jan. 15, 2015

(30) Foreign Application Priority Data

Feb. 2, 2012 (SG) ..... 201200774-6

(51) Int. Cl.
*A61J 1/20* (2006.01)
*A61J 1/14* (2006.01)

(52) U.S. Cl.
CPC ..... *A61J 1/2096* (2013.01); *A61J 1/1406* (2013.01); *A61J 1/1418* (2015.05); *A61J 1/201* (2015.05);

(Continued)

(58) Field of Classification Search
CPC ..... A61J 1/14–1/22; A61J 2001/2003; A61J 2001/201; A61J 2001/2013; A61J 2001/2051; A61J 2001/2082; A61J 2001/2086; A61J 7/04; A61J 7/0436; B65D 47/00; B65D 47/20–47/32
See application file for complete search history.

(56) References Cited

U.S. PATENT DOCUMENTS 2,459,304 A * 1/1949 Blank ..... 215/247
3,940,003 A 2/1976 Larson (Continued)

FOREIGN PATENT DOCUMENTS

EP 0696994 B1 12/1996
EP 0836465 A1 4/1998

(Continued)

*Primary Examiner* — Philip R Wiest
*Assistant Examiner* — Benjamin Klein
(74) *Attorney, Agent, or Firm* — The Webb Law Firm

(57) ABSTRACT

An adaptor for coupling with a medical container having a collar closed by a septum including: a tubular body closed at a distal end with a transversal wall from which extends a hollow spike, and at a proximal end by a pierceable elastomeric piece including a cavity having a plurality of circumferentially distributed chambers, each chamber being connected to the hollow spike by a radial channel, the tubular body further receiving an intermediate piece including a plurality of through holes aligned on the chambers, a selecting member having a closure wall provided with one opening, capable of rotating so that the opening is successively aligned with each of the through holes, and a gripping member for securing the adaptor to the medical container. Also, an assembly including the adaptor and a medical container.

10 Claims, 4 Drawing Sheets

(52) U.S. Cl.
CPC ..... *A61J 1/2058* (2015.05); *A61J 2001/201* (2013.01); *A61J 2001/2058* (2013.01); *Y10T 137/9029* (2015.04)

(56) References Cited

U.S. PATENT DOCUMENTS

| | | | | |
|---|---|---|---|---|
| 4,564,045 | A | 1/1986 | Koch et al. | |
| 4,576,211 | A | 3/1986 | Valentini et al. | |
| 4,768,568 | A | 9/1988 | Fournier et al. | |
| 5,342,319 | A | 8/1994 | Watson et al. | |
| 5,454,409 | A | 10/1995 | McAffer et al. | |
| 5,498,253 | A | 3/1996 | Aswad et al. | |
| 5,533,994 | A | 7/1996 | Meyer | |
| 5,620,433 | A | 4/1997 | Aswad et al. | |
| 5,678,718 | A | 10/1997 | Morris et al. | |
| 5,772,652 | A | 6/1998 | Zielinski | |
| 5,827,262 | A | 10/1998 | Neftel et al. | |
| 5,829,589 | A | 11/1998 | Nguyen et al. | |
| 5,887,633 | A | 3/1999 | Yale et al. | |
| 6,258,078 | B1 | 7/2001 | Thilly | |
| 6,453,956 | B2 | 9/2002 | Safabash | |
| 6,571,837 | B2 | 6/2003 | Jansen et al. | |
| 6,626,309 | B1 | 9/2003 | Jansen et al. | |
| 6,715,520 | B2 | 4/2004 | Andreasson et al. | |
| 6,880,722 | B2 | 4/2005 | Anderson et al. | |
| 7,100,646 | B2 | 9/2006 | Py et al. | |
| 7,263,411 | B2 | 8/2007 | Shows et al. | |
| 7,382,692 | B1 | 6/2008 | Hildebrandt | |
| 7,530,974 | B2 | 5/2009 | Domkowski et al. | |
| 7,621,273 | B2 | 11/2009 | Morton et al. | |
| 7,805,216 | B2 | 9/2010 | Shows et al. | |
| 8,002,130 | B2 | 8/2011 | Thilly | |
| 8,034,042 | B2 | 10/2011 | Domkowski et al. | |
| 8,042,714 | B2 | 10/2011 | Miyazaki et al. | |
| 8,090,471 | B2 | 1/2012 | Shows et al. | |
| 8,091,727 | B2 | 1/2012 | Domkowski | |
| 8,113,199 | B2 | 2/2012 | Augustyn et al. | |
| 8,122,923 | B2 * | 2/2012 | Kraus et al. | 141/329 |
| 8,123,736 | B2 | 2/2012 | Kraushaar et al. | |
| 8,157,784 | B2 | 4/2012 | Rogers | |
| 8,225,949 | B2 | 7/2012 | Aneas | |
| 8,303,572 | B2 | 11/2012 | Adair et al. | |
| 8,479,732 | B2 | 7/2013 | Stuart et al. | |
| 2004/0119203 | A1 | 6/2004 | Keirstead et al. | |
| 2004/0199139 | A1 | 10/2004 | Fowles et al. | |
| 2008/0306439 | A1 * | 12/2008 | Nelson et al. | 604/84 |
| 2009/0050213 | A1 | 2/2009 | Biddell et al. | |
| 2009/0120934 | A1 | 5/2009 | Domkowski | |
| 2009/0314291 | A1 | 12/2009 | Anderson et al. | |
| 2010/0059474 | A1 | 3/2010 | Brandenburger et al. | |
| 2010/0176080 | A1 * | 7/2010 | Grunert et al. | 215/247 |
| 2011/0147333 | A1 | 6/2011 | Grek et al. | |
| 2012/0000569 | A1 | 1/2012 | Wiegel | |
| 2012/0116579 | A1 | 5/2012 | Shows et al. | |
| 2012/0123381 | A1 | 5/2012 | Kraus et al. | |
| 2012/0203193 | A1 | 8/2012 | Rogers | |
| 2013/0066293 | A1 * | 3/2013 | Garfield et al. | 604/408 |
| 2013/0204201 | A1 | 8/2013 | Avery et al. | |
| 2013/0231630 | A1 | 9/2013 | Kraus et al. | |
| 2013/0253432 | A1 | 9/2013 | Avery et al. | |
| 2014/0163468 | A1 | 6/2014 | Avery et al. | |

FOREIGN PATENT DOCUMENTS

| | | | |
|---|---|---|---|
| EP | 0904763 | A2 | 3/1999 |
| EP | 0960616 | A2 | 12/1999 |
| EP | 1034772 | A1 | 9/2000 |
| EP | 1221924 | B1 | 3/2004 |
| EP | 1539577 | A2 | 6/2005 |
| EP | 1687203 | A2 | 8/2006 |
| EP | 1962932 | A2 | 9/2008 |
| EP | 1879642 | B1 | 7/2009 |
| EP | 2114345 | A1 | 11/2009 |
| EP | 2298406 | A1 | 3/2011 |
| EP | 2383199 | A1 | 11/2011 |
| EP | 2555814 | A1 | 2/2013 |
| EP | 2555815 | A1 | 2/2013 |
| EP | 2603260 | A1 | 6/2013 |
| EP | 1730676 | B1 | 8/2013 |
| FR | 2560049 | A1 | 8/1985 |
| FR | 2708204 | A1 | 2/1995 |
| WO | 9400094 | A1 | 1/1994 |
| WO | 9507066 | A1 | 3/1995 |
| WO | 0152920 | A2 | 7/2001 |
| WO | 2004073775 | A1 | 9/2004 |
| WO | 2011072226 | A1 | 6/2011 |
| WO | 2012118923 | A2 | 9/2012 |

* cited by examiner

ADAPTOR FOR COUPLING TO A MEDICAL CONTAINER

CROSS-REFERENCE TO RELATED APPLICATIONS

This application is the United States national phase of International Application No. PCT/SG2013/000045 filed Feb. 1, 2013, and claims priority to Singapore Patent Application No. 201200774-6 filed Feb. 2, 2012, the disclosures of which are hereby incorporated in their entirety by reference.

BACKGROUND OF THE INVENTION

1. Field of the Invention

The present invention relates to an adaptor for coupling to a medical container containing a pharmaceutical product, such as a vial for a vaccine, said adaptor allowing for multiple aseptic needle piercings with an injection device to be filled with part of the product contained in the medical container.

2. Description of Related Art

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the medical container to the injection device.

One of the ways to improve health is to immunize entire populations against a number of diseases. To date, injection administration is the most common method of administering vaccines.

Each year, numerous drugs, for example vaccines, need to be prepared throughout the world by healthcare institutions. Many vaccine compositions are usually not stable at room temperatures and they must be stored at rather specific cold temperatures. Indeed, due to their biological nature, vaccines are complex to handle and to store. Vaccines are usually temperature sensitive and typically need to be maintained and stored at all time between 2 and 8 degrees Celsius (° C.). Some vaccines will be more sensitive to heat exposure and others will be sensitive to freezing. Therefore, maintaining and monitoring the appropriate temperatures during the storage and the handling of vaccines is a critical issue in order to sustain their efficacy. Overexposure to heat as well as overcooling may result in the destruction of the biological elements of the vaccines. Use of vaccines not stored in appropriate conditions may lead to not effective vaccination of the populations against diseases and may lead to expensive campaigns with limited results.

Furthermore, it is critical that the cold chain be not interrupted from production of the drug at a pharmaceutical company to its administration to the patient.

From a supply chain perspective, the most efficient vaccine packaging is the multidose container such as a multidose vial, that is to say, vial that may contain up to 10, 100 or 1000 doses of vaccine, one dose being intended for one patient. These vials are usually closed by a septum. In preparation of an injection of a vaccine, the user pierces the septum of the vial with the needle of an empty syringe, he then fills the syringe with one dose of vaccine and proceeds to the injection of the vaccine to the patient.

As such, multidose vials imply that the septum of the vial be pierced successively a high number of times, namely as many as the number of doses present in the vial. In order to ensure safe injections, the sterility of the septum of the vial should be maintained during the whole time the vial is used.

Anyway, in locations where it is difficult to maintain favorable hygienic conditions such as remote locations which are far from towns and from hospital facilities, the multidose vials may be handled and manipulated at ambiant air. In such cases, the septum of the vial may be contaminated either by the ambiant air, or, each time a dose of vaccine is removed, by the needle of the empty syringe used.

In addition, in regions where there is limited or potentially no supply of energy to power cooling equipment such as a refrigerator, the multidose vials may be maintained in cold conditions by simple contact with ice packs. As time goes by, part of the ice may melt and turn into water, and the septum of the multidose vials may be in contact with such water that may contaminate the septum of the vial.

It may then happen that a multidose vial, such as for example a 10-dose vial, is opened and that only three doses are used, for vaccinating three patients only, the remaining content of the vial being wasted because not intended to be administered in a sufficiently short time after opening of the vial in order to guaranty the vaccine or drug sterility.

Vaccination campaigns can therefore be made difficult in some regions and a significant proportion of vaccines may be wasted by the time they reach their target. This has an unacceptable cost to the health organizations in charge of immunization campaigns. In addition, it may happen that in case of vaccination campaigns, or pandemic, hundreds of patients need to be vaccinated in a very short time, in locations where it is difficult to maintain favorable hygienic conditions such as remote locations which are far from towns and from hospital facilities.

Therefore, it would be desirable to provide a device that would allow multiple successive safe piercings of a septum of a medical container, such as a multidose vial, and that would guarranty that said piercing be carried out in aseptic conditions, in particular that the septum be maintained sterile during the lifetime of the multidose vial, despite the fact that successive steps of withdrawal of doses of product are repeated with regard to the same multidose medical container.

SUMMARY OF THE INVENTION

A first aspect of the present invention is an adaptor for coupling with a medical container having a collar closed by a septum, said septum having an outer surface directed towards the outside of the medical container, the adaptor comprising:

- a tubular body substantially closed at its distal end with a transversal wall provided with a central hole from which extends a hollow spike in the distal direction for passage of a fluid, and substantially closed at its proximal end by a pierceable elastomeric piece, said pierceable elastomeric piece, transversal wall and tubular body together defining an inner cavity, said inner cavity comprising a plurality of circumferentially distributed chambers, each chamber being connected to said hollow spike by a radial channel,
- said tubular body further receiving an intermediate piece located proximally with respect to said pierceable elastomeric piece, said intermediate piece comprising a plurality of through holes, each through hole being aligned on one chamber of said plurality of chambers,
- a selecting member located proximally with respect to said intermediate piece, said selecting member comprising a closure wall provided with one opening, said selecting member being capable of rotating with respect to said intermediate piece, so that said opening is successively aligned with each of said through holes, a gripping member for securing the adaptor to the medical container so that the distal surface of said transversal wall is brought in contact with the outer surface of said septum when said adaptor is secured on said medical container and said hollow spike pierces said septum.

The adaptor of the invention is intended to be mounted on a medical container, such as for example a conventional vial for storing pharmaceutical products, such as multidose vials for vaccines. Such a vial 1 is shown on FIGS. 1A-1C and generally comprises a tubular barrel 2 having a longitudinal axis A, closed at an end and having a collar 3 at the opposite end, said collar 3 being closed by a septum 4. Usually, the septum 4 is fixedly attached to the collar 3 of the vial 1 by a peripheral band 5, said peripheral band 5 leaving a part of the septum 4, herein called outer surface 4*a* of the septum 4, directly facing the outside of the vial 1, namely the outside environment. The septum 4 is usually made of a gas and liquid impermeable material and it seals hermetically the content of the vial 1. The septum 4 is also pierceable by the needle of an injection device intended to be filled by a dose of the product contained in the vial, said septum 4 being accessible to said needle via its outer surface 4*a*.

In the present application, "pierceable" means that the septum or the elastomeric piece of the adaptor may be pierced and traversed by the needle of an injection device such as a syringe, an auto-injector or a reconstitution device for example for administering a pharmaceutical product such as a drug or vaccine.

The gripping member of the adaptor of the invention may be any member capable of securing the adaptor around on the medical container, and in particular around the collar of the medical container, either in a temporary or permanent way.

The adaptor of the invention allows piercing the septum of a medical container in favorable hygienic conditions and then to complete as many withdrawal steps of product from said medical container as possible in view of the number of doses contained in the medical container, with no risk of contaminating either the septum of the medical container or the inside of said medical container.

Indeed, when the user decides to fill a series of empty injection devices with doses of drug or vaccine contained in the medical container, he simply secures the adaptor of the invention on the medical container by means of the gripping member, thereby bringing in contact the distal surface of the transversal wall of the adaptor and the outer surface of the septum and piercing the septum with the hollow spike. The inside of the medical container is therefore connected to the hollow spike, yet not with the chambers, the radial chambers being closed by their closure members, each in its locked state. Therefore, each chamber is empty, clean and sterile as long as no dose of product has been withdrawn from the medical container.

Once the adaptor is secured on the medical container, the user rotates the selecting member so as to cause the opening to face a through hole of the intermediate piece. The user then introduces the needle of the injection device to be filled inside the through hole and causes the needle to pierce the pierceable elastomeric piece. During this step, the needle mechanically rubs against the material forming the elastomeric piece and it is naturally cleaned, as the potential bacteria are wiped out from the needle when said needle penetrates the elastomeric piece. In addition, once the needle protrudes out of the elastomeric piece of the adaptor, it enters in the sterile chamber of the adaptor which is aligned to the through hole previously traversed. The chamber being filled with decontaminated air, the needle is therefore not contaminated.

The user then proceeds to the withdrawal of the product from the medical container. As the user pulls proximally on, a piston rod of the injection device to be filled, a vacuum is created in the chamber in use. The closure member of the radial channel of the chamber in use is caused to transition to its open state, and the product from the medical container is sucked through the hollow spike, then in the radial channel and in the chamber in use. The closure members of the radial channels to the chambers not in use are not affected by the vacuum created in the chamber in use, and they remain in their locked state, preventing the other chambers from contributing or being submitted to any potential contamination caused by the operation in progress in the through hole and chamber in use.

As the piercing of the septum of the medical container is decoupled from the dose withdrawal, the septum of the medical container is only pierced once by the hollow spike and all the dose removals are performed in independent and sterile chambers, the different piercings of the pierceable elastomeric piece by the successive injection devices taking place in different areas of the surface of the pierceable elastomeric piece. Therefore, the adaptor of the invention allows proceeding to the withdrawal of a dose of product contained in a multidose vial in favorable hygienic conditions a high number of times, since it avoids all contact between the outside environment and the product contained inside the medical container.

The user may repeat this piercing step with the needle of a new empty syringe until all the doses contained in the medical container are removed. For each new withdrawal of product, the user rotates the selecting member so as to put the opening in alignment with a new through hole and with a new chamber, not yet used and therefore not yet submitted to ambient and/or contaminating air. He then repeats the withdrawal step described above. The adaptor of the invention acts as a protection of the septum and of the product contained in the medical container.

In embodiments, the pierceable elastomeric piece comprises a flat cylinder provided in the central region of its distal surface with a plurality of flexible distal radial tentacles capable of deflecting proximally, each tentacle facing a radial channel, said tentacle closing said radial channel when in a non deflected state, and leaving said radial channel open when in a deflected state. This tentacle acts as a non return valve avoiding all back flow of the product from the chamber used to the medical container but also preventing all contamination of the not yet used chambers.

In embodiments, the gripping member is an axial clipping member capable of being axially mounted on the collar of said medical container. For example, the axial clipping member comprises a deflecting skirt capable of being axially engaged on said collar, said deflecting skirt extending from said transversal wall in the distal direction.

In embodiments, the adaptor further comprises an indicator system for informing the user about which through hole, out of said plurality of through holes, said opening is aligned with. For example, said selecting member comprising a tubular wall receiving a lateral wall of said intermediate piece, the indicator system comprises a window provided on said tubular wall of said selecting member, said window facing a different information data located on said lateral wall of said intermediate piece, each time said opening is aligned with a new through hole after rotation of the selecting member with respect to said intermediate piece. Such an indicator system allows the user to know how many doses of product remain in the medical container or how many doses are already removed from the medical container. Such an indicator also provides insurance for the user that he is using a new chamber not yet used.

In embodiments, the pierceable elastomeric piece is made of a gas and liquid impermeable material capable of flexing under pressure. The pierceable elastomeric piece may show a hardness ranging from about 10 to about 100 Shore A, preferably from about 40 to about 70 Shore A, measured according to standard DIN 53505.

Suitable materials for the pierceable elastomeric piece of the adaptor of the invention include natural rubber, acrylate-butadiene rubber, cis-polybutadiene, chloro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethyleneterpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

In embodiments, the pierceable elastomeric piece is self-resealing. By "self-resealing" it is meant that the elastomeric piece closes again the hole produced by the piercing of the needle, automatically and rapidly, for example in less than 0.5 seconds, once the needle is removed from the pierceable elastomeric piece. A self-resealing pierceable elastomeric piece prevents contamination from the outside environment from entering the chamber after removal of the needle of the injection device, and provides for additional protection of the product stored in the medical container. Indeed, the product is therefore isolated from the outside environment by two different barriers: the tentacles act as non return valves and the pierceable elastomeric piece is covering the chambers. Furthermore, as each chamber is used only once, a specific and different area of the pierceable elastomeric piece is pierced at each dose withdrawal.

Suitable materials for self-resealing pierceable elastomeric piece of the adaptor of the invention include synthetic polyisoprene, natural rubber, silicone rubber, thermo-plastic elastomers, or the like or a combination thereof.

In embodiments, the adaptor comprises a blister surrounding said adaptor in a storage state. The blister allows maintaining sterility of the adaptor during shelf-life, i.e. before securing the adaptor onto the medical container. The user then removes the blister before mounting the adaptor on the medical container.

In embodiments, the adaptor is provided with an air inlet having a filter, for allowing decontaminated air to enter the medical container; For example, the filter may have a pore size of approximately 0.22 microns.

Another aspect of the invention is an assembly comprising a medical container having a collar closed by a septum, said septum having an outer surface directed towards the outside of the medical container, and an adaptor as described above.

DESCRIPTION OF THE INVENTION

Figure 1A:
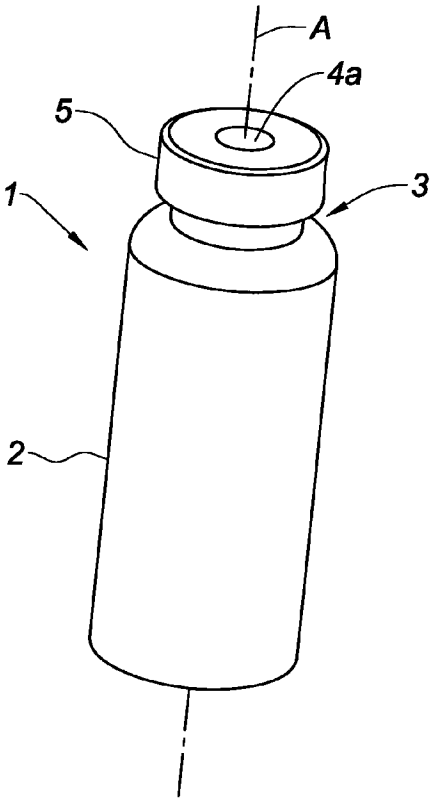
FIGS. 1A-1C are respectively a perspective view, a partial side view and a partial cross section view of a conventional vial on which the adaptor of an embodiment according to the invention is to be mounted.
Figure 1B:
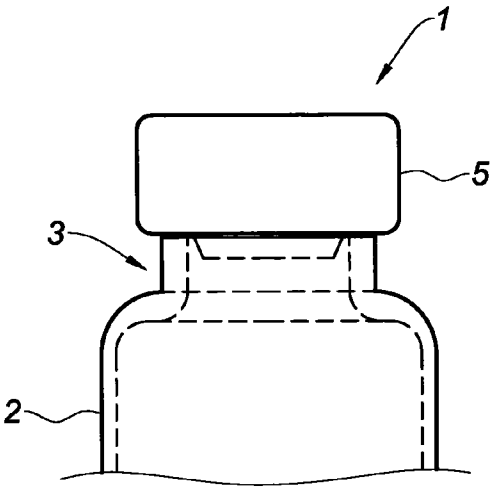
Figure 1C:
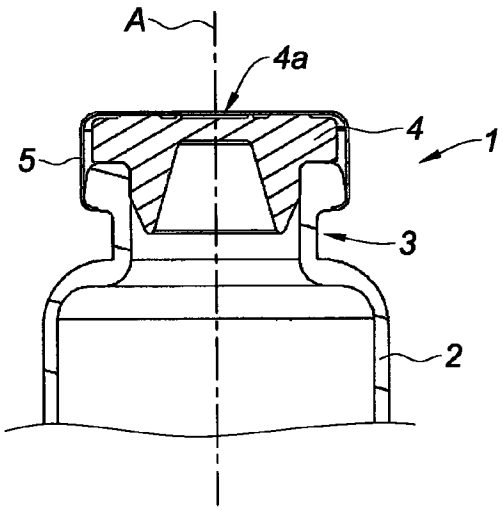
Figure 2C:
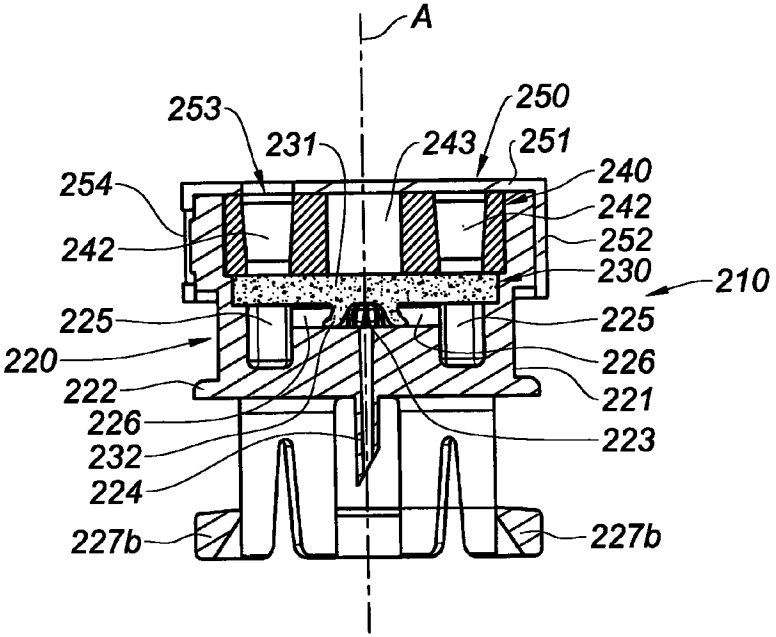
FIGS. 2A-2C are respectively a perspective view from the top, a perspective view from the bottom, and a cross section view of an embodiment of an adaptor of the invention.
Figure 2A:
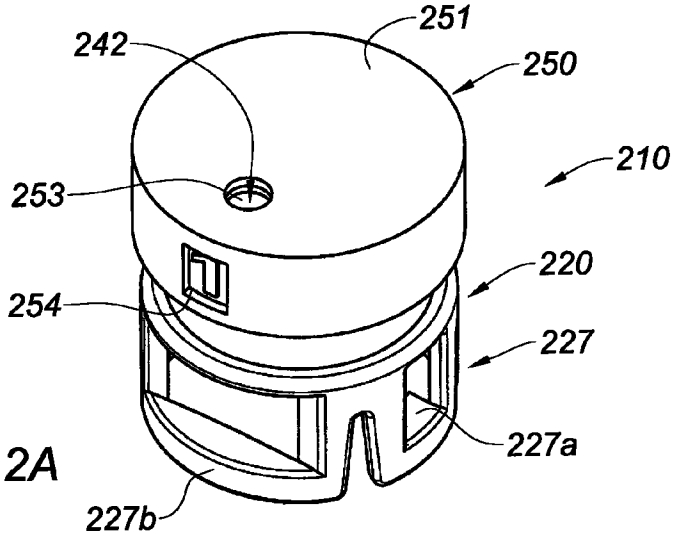
Figure 2B:
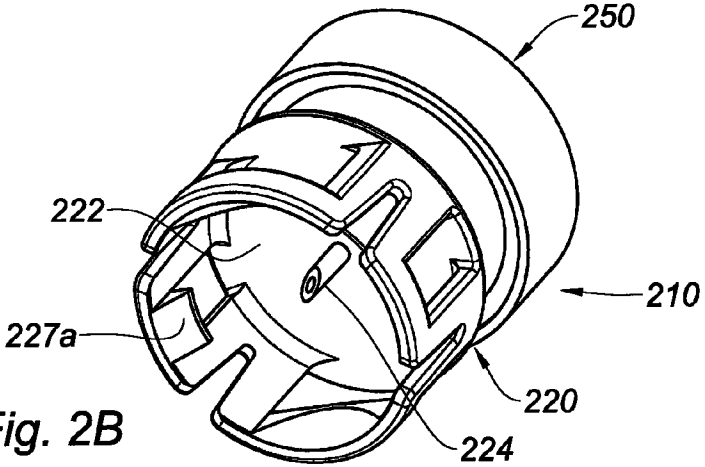
Figure 3:
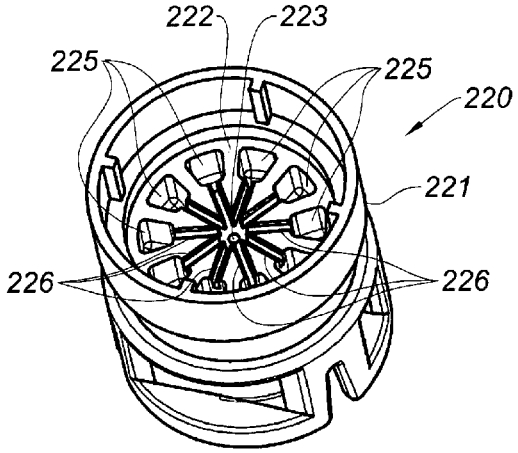
FIG. 3 is a perspective view from the top of the tubular body of the adaptor of FIGS. 2A-2C.

With reference to FIGS. 2A-2C is shown an adaptor 210 of the invention intended to be coupled to a vial 1 of FIGS. 1A-1C in order to remove doses of product from the vial 1 with an injection device in favorable hygienic conditions.

The adaptor 210 has a longitudinal axis A and comprises a tubular body 220, a pierceable elastomeric piece 230, an intermediate piece 240 and a selecting member 250.

With reference to FIGS. 2A-C and 3, the tubular body 220 will now be described in details. The tubular body comprises a tubular element 221 closed at its distal end with a transversal wall 222. The transversal wall 222 is provided with a central hole 223 from which extends a hollow spike 224 in the distal direction: as shown below, the hollow spike 224 will provide a passage for the fluid contained in the vial 1 once the adaptor 210 is secured on the vial 1 and the hollow spike 224 pierces the septum 4 of the vial 1. Extending proximally from the transversal wall 222, is present a plurality of chambers 225, ten of them on the example shown, which are circumferentially distributed. Each chamber 225 is connected to the central hole 223 and hollow spike 224 via a radial channel 226.

Figure 7B:
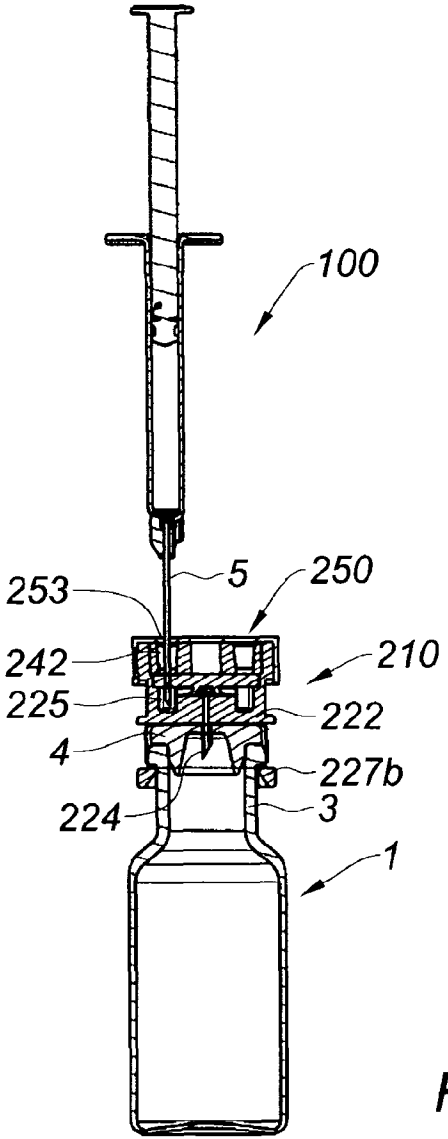

A deflecting skirt 227 extends distally from the transversal wall 222. This deflecting skirt 227 is intended to act as a gripping member for securing the adaptor 210 on the collar 3 of the vial 1: as such, the deflecting skirt 227 is dimensioned and shaped so as to be capable of surrounding the collar 3 of the vial 1 of FIGS. 1A-1C. The deflecting skirt 227 is provided with four distal slots defining four radially outwardly deflecting legs, two of them being provided with inner pegs 227*a*, the other two being provided outer pegs 227*b*, said inner pegs 227*a* and outer pegs 227*b* being capable of engaging the collar 3 of the vial 1 as shown in FIG. 7B.

Figure 4:
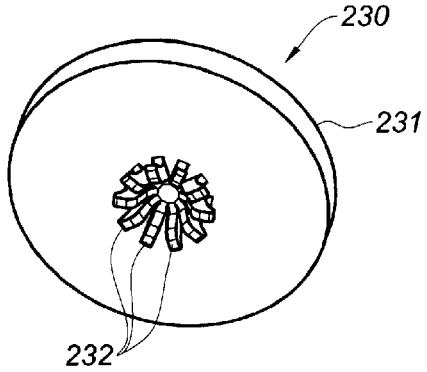
FIG. 4 is a perspective view from the bottom of the pierceable elastomeric piece of the adaptor of FIGS. 2A-2C.

With reference to FIGS. 2C and 4, the pierceable elastomeric piece 230 has the global shape of a flat cylinder 231. The flat cylinder 231 is provided in the central region of its distal surface with a plurality of flexible distal radial tentacles 232 capable of deflecting proximally. The number of tentacles 232 is identical to that of radial channels 226, each tentacle 232 being intended to close the radial channel 224 it faces (see FIG. 2C) when in its non deflected state.

The elastomeric piece 230 is made of a gas and liquid impermeable material capable of flexing under pressure. The pierceable elastomeric piece may show a hardness ranging from about 10 to about 100 Shore A, preferably from about 40 to about 70 Shore A, measured according to standard DIN 53505.

Suitable materials for the pierceable elastomeric piece 30 of the adaptor of the invention include natural rubber, acrylate-butadiene rubber, cis-polybutadiene, chloro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethyleneterpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it automatically seals the hole produced by the piercing of the needle, automatically and rapidly, for example in less than 0.5 seconds, once the needle is removed from the elastomeric piece. This automatic closure step may occur a high number of times, for example as many times as necessary for removing the numerous doses of products present in the multidose vial 1. Suitable materials for self-resealing pierceable elastomeric piece of the adaptor of the invention include synthetic polyisoprene, natural rubber, silicone rubber, thermo-plastic elastomers, or the like or a combination thereof.

In embodiments, the pierceable elastomeric piece may further comprise a material including antiseptic agents, such as silver ions or copper ions. For example, silver salt or copper salt may be covalently linked to the polymer matrix of material comprised in the pierceable elastomeric piece. Alternatively, silver salts or copper salts may be included as a load during the manufacturing of the polymer comprised in the pierceable elastomeric piece. For example, the polymer matrix may be selected from silicone rubber, butyl rubber and/or halogenobutyl rubber.

In embodiments, the pierceable elastomeric piece is made of a material comprising a silicone rubber including silver ions: such products are commercially available from the company Momentive Performance Materials under the tradename "Statsil®" or "Addisil®". In other embodiments, the pierceable elastomeric piece consists in a material including silver ions, such as silicone rubber including silver ions. In other embodiments, the pierceable elastomeric piece may consist in a material including copper ions.

Pierceable elastomeric pieces of the adaptor of the invention, comprising a material including antiseptic agents, such as silver ions or copper ions, show antiseptic properties. The growth of bacteria at the surface of the pierceable elastomeric piece is therefore directly prevented. These materials also show hydrophobic properties which prevent condensation formation, thereby further reducing growth of bacteria. As a consequence, when a needle pierces a pierceable elastomeric piece including such antiseptic agents, in view of entering a vial for removing a dose of product from said vial, the risk of contamination of the vial content is reduced.

Alternatively or in combination, the pierceable elastomeric piece may comprise a coating comprising an antiseptic agent, such as chlorhexidine di-acetate. For example, the pierceable elastomeric piece may comprise a butyl rubber or a halogenobutyl rubber coated with a coating comprising chlorhexidine di-acetate. Such a coating may be obtained by UV cross-linking. The antiseptic action of such a coating may occur within minutes and such a coating may therefore be able to clean a contaminated needle during its insertion within the pierceable elastomeric piece.

Figure 5:
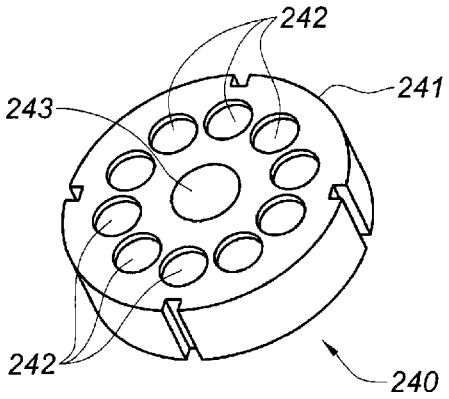
FIG. 5 is a perspective view from the top of the intermediate piece of the adaptor of FIGS. 2A-2C.

With reference to FIGS. 2C and 5, the intermediate piece 240 has the global shape of a cylinder 241 traversed by a plurality of circumferentially distributed through holes 242. The number of through holes 242 is identical to that of the chambers 225. Each through hole 242 is intended to be aligned with a chamber 225, as shown on FIG. 2C. On the example shown, the intermediate piece 240 is further provided with a central hole 243.

Figure 6:
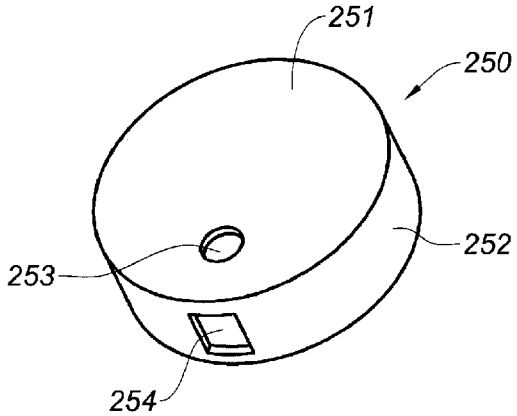
FIG. 6 is a perspective view from the top of the selecting member of the adaptor of FIGS. 2A-2C, FIGS. 7A and 7B are respectively a perspective view and a cross section view of the adaptor of FIGS. 2A-2C once secured on the collar of a vial during a withdrawal step.

With reference to FIGS. 2C and 6, the selecting member 250 comprises a proximal transversal wall 251 intended to act as closure wall of the intermediate piece 240, and a tubular wall 252 extending distally from the proximal transversal wall 251. The proximal transversal wall 251 is provided with an opening 253 radially spaced with respect to the center of the proximal transversal wall 25. As shown in FIG. 2C, this opening 253 is intended to be aligned with one through hole 242 during use of the adaptor 210. In the same radial direction than the opening 253, the tubular wall 252 is provided with a window 254. As shown in FIGS. 2A and 2C, the tubular wall 252 is intended to receive the intermediate piece 240, so that the window 254 be capable of facing information data present on the lateral wall of the cylinder 241 of the intermediate piece 240. On the example shown on FIG. 2A, the information data is a digit "1" appearing through window 254. The digit for the next withdrawal step will be "2", and so on, thereby indicating to the user how many doses of product remain in the vial 1 or have already be removed from the vial 1. The plurality of digits present on the lateral wall of the cylinder 241 of the intermediate piece 240 together with the window 54 form an indicator system for informing the user on which selected through hole, out of said plurality of through holes, is aligned with the opening.

In the use position of the adaptor 210, as shown on FIG. 2C, the pierceable elastomeric piece 230 is received within the tubular element 221 so as to close the plurality of chambers 225, with each tentacle 232 being in a non deflected state so as to close the radial channel 226 it faces. The intermediate piece 240 is received within the tubular element 221 of the tubular body 220, and is located proximally with respect to the pierceable elastomeric piece 230, with each through hole 242 being aligned with one chamber 225. The selecting member 250 is then put on top of the intermediate piece 240 so as to close the through holes 242, only one through hole being left open because aligned with the opening 253 of the selecting member 250. With such a system, the totality of the through holes 242 may be used for giving information either on the remaining doses or on the doses already withdrawn, but in an alternative, one of the plurality of through holes 242 may be used as a control through hole: this control through hole is selected to face the opening 253 when the adaptor 210 is in a storage position before the first use.

Figure 7A:
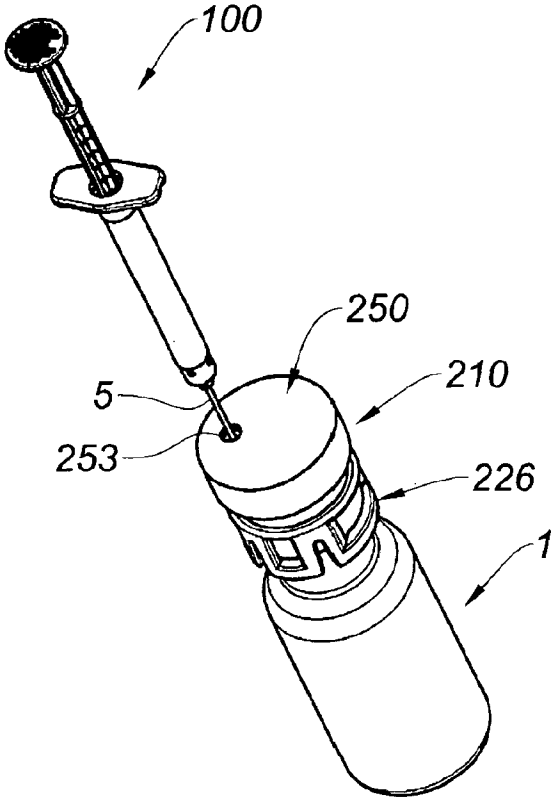

The use of the adaptor 210 will now be explained with reference to FIGS. 2C and 7A-B. When a user is ready to proceed to a step of withdrawal of a dose of product from the vial 1 with an injection device 100, he grasps the adaptor 210 and secures it on the collar 3 of the vial 1 by axially clipping the deflecting skirt 227 on the collar 3 by means of inner pegs 227*a* and outer pegs 227*b* engaging the collar 3 of the vial 1: the hollow spike 224 therefore pierces the septum 4 and the transversal wall 222 comes in close contact with the septum 4, as shown on FIG. 7B.

In order to be sure to be using non contaminated through hole 242 and chamber 225, the user rotates the selecting member 250 so as to bring the opening 253 face to face with a non yet used through hole 242. For example, for the first withdrawal of product, the user rotates the selecting member 250 and sees the digit "1" appearing, as shown on FIG. 2A. The digit indicates to the user which dose, out of a determined number, for example nine in the present example if one through hole is used as control through hole, he will be withdrawing.

The user then introduces the needle 5 of the injection device 100 inside the opening 253, then inside the through hole 242 facing said opening 253: he then continues pushing on the needle 5 which pierces the pierceable elastomeric piece 230. During this step, the needle 5 mechanically rubs against the material forming the elastomeric piece 230 and it is naturally cleaned, as the potential bacteria are wiped out from the needle 5 when said needle 5 penetrates the elastomeric piece 230.

In addition, once the needle 5 protrudes out of the elastomeric piece 230 of the adaptor 210, it enters in the chamber 225 aligned with the through hole 242 used. As the chamber 225 being filled with decontaminated air and the needle 5 has been cleaned by the pierceable elastomeric piece 230, the dose removal can thus take place with favorable hygienic conditions without any contamination of the needle 5 or of the product to be withdrawn from the vial 1.

The user then pulls in the proximal direction on the piston rod and plunger of the injection device 100: as a consequence, a vacuum is created in the chamber 225 in use, i.e the chamber 225 into which the distal tip of the needle 5 protrudes. The distal radial tentacle 232 facing the radial channel 226 of the chamber 225 in use is caused to deflect proximally under the effect of the vacuum created in the chamber 225 in use. The radial channel 226 of the chamber 225 in use therefore opens; under the effect of the vacuum created in the chamber 225 in use, the liquid from the vial 1 is sucked through the hollow spike 224 and travels along the open radial channel 226 towards the chamber 225 in use. During this step, because no vacuum is created in the chambers 225 which are not in use, the other radial distal tentacles 232 are not caused to deflect proximally and the other radial channels 226 (not in use) remain closed, thereby avoiding contributing or being submitted to any potential contamination caused by the operation in progress in the through hole 242 and chamber 225 in use.

The user then withdraws the required dose of product from the liquid now present in the chamber 225 in use in order to fill in the injection device 100. He removes the needle 5 from the adaptor 210. The tentacle 232 of the chamber used comes back to its rest position and closes the radial channel 232 which has been used. This different steps sequential therefore avoids back-flow of the product from the chamber 225 used to the inside of the vial 1 as well as contamination of the not yet used chambers. Since the dose removal does not take place directly into the vial 1 but in a remote and independent chamber, the vial 1 cannot be contaminated during the withdrawal step. The product stored in the vial 1 is maintained sterile and its efficiency is insured.

In the embodiment shown, the vial 1 is maintained under negative pressure from the first dose removal to the last one. In other embodiments not shown, an air inlet may be provided for example with a filter, in order to allow decontaminated air to enter inside the vial 1. If a filter is used, the pore size would be approximately of 0.22 microns to ensure efficient filtration of the air. This filter may also be provided with silver antimicrobial additive in order to obtain a supplementary protection of the vial sterility. Alternatively or in addition, this filter may be provided with a chlorhexidine coating. Such a filter is commercially available from Porex® under the tradename Barrier Technology™.

The user may repeat the step described above for the next withdrawal of product, after having rotated the selecting member 250 so as to use a through hole 242 and chamber 225 not yet used. For example, after having withdrawn the dose corresponding to digit "1" as shown on FIG. 2A, the user rotates the selecting member 250 in order to put the opening 253 face to face to the newt through hole 242, and the digit "2" will appear through the window 254. The user then knows he can proceed to a new step of withdrawal of product in favorable hygienic conditions.

Indeed, with the adaptor 210 of the invention, the septum 4 of the vial 1 is pierced only once, by the hollow spike 224. The adaptor 210 therefore acts as a protection of the septum 4 during the whole lifetime of the vial 1, namely until all the doses of product contained in the vial 1 are removed.

Additionally, in all the previous described embodiments of the present invention, the adaptor 210 can be provided with a time monitoring system (not shown). Indeed, and according to current health policies, the content of the vial 1 is usually considered as unsafe for injection after a limited period of time, for example until 28 to 30 days, even if an adaptor 210 according to the present invention is mounted of the vial 1. Therefore, a time monitoring system can be added to the adaptor according to the invention in order to monitor the elapsing time from the first dose withdrawing or to indicate to the user what is the time remaining before the 28 or 30 days deadline.

This time monitoring system could be an electronic timer or a system based on the diffusion of ink into a circuit. For example, the elapsing or remaining time can be monitored by the kinetic of ink progression in a microfluidic circuit. Such systems are particularly attractive because they are small and reliable. For example, such a system could be integrated onto the outside surface of the proximal transversal wall 251 of the selecting member 250. Such systems are commercially available under the trademark Timestrip®.

Furthermore, the time monitoring system could be triggered either manually by the user or automatically. An automatic trigger could occur when the adaptor 210 is mounted on the collar 3 of the vial 1, which assumes a first dose withdrawing shortly afterwards. For example, when an adaptor 210 is provided with a close blister (not shown), the time monitoring label could be triggered by the opening of the blister.

Such a time monitoring system is valuable to prevent the injection of potentially expired vaccines or drugs to patients. Moreover, it also facilitates the supply chain or stock management in drugstores and avoids wastage of valuable drugs and vaccines by encouraging the use of the first opened vials.

The adaptor of the invention allows proceeding to the withdrawal of a dose of product contained in a multidose vial in favorable hygienic conditions a high number of times. Indeed, each dose removal takes place in a new, clean dedicated chamber, thereby avoiding contamination of the product contained in the vial. The needle of the injection device is therefore not contaminated during this step. Moreover, the hygienic conditions are maintained as the piercing of the vial septum is decoupled from the withdrawal of the dose with the injection device. These hygienic conditions are also maintained because the inside of the medical container is isolated from the outside environment by two barriers, namely the closure member (tentacles) of the radial channels and by the pierceable elastomeric piece, thereby leading to an optimal storage of the product contained in the medical container.

The invention claimed is:

1. An adaptor for coupling with a medical container having a collar closed by a septum, said septum having an outer surface directed towards an outside of the medical container, the adaptor comprising:

a tubular body substantially closed at a distal end with a transversal wall provided with a central hole from which extends a hollow spike in a distal direction for passage of a fluid, a plurality of circumferentially distributed chambers extending from said transversal wall in a proximal direction, said chambers being closed at a proximal end by a pierceable elastomeric piece, each chamber being connected to said hollow spike by a radial channel provided with a closure member, said closure member being capable of transitioning from a locked state, in which it closes the radial channel, to an open state in which it does not close said radial channel, each chamber being filled with decontaminated air and each closure member being in a locked state in a storage state of said adaptor, said tubular body further receiving an intermediate piece located proximally with respect to said pierceable elastomeric piece, said intermediate piece comprising a plurality of circumferentially distributed through holes, each through hole being aligned on one chamber of said plurality of chambers, a selecting member located proximally with respect to said intermediate piece, said selecting member comprising a closure wall provided with one opening, said selecting member being capable of rotating with respect to said intermediate piece, so that said opening is capable of being successively aligned with each of said through holes, a gripping member for securing the adaptor to the medical container, so that a distal surface of said transversal wall is brought in contact with the outer surface of said septum when said adaptor is secured on said medical container and said hollow spike pierces said septum.

2. The adaptor of claim 1, wherein the pierceable elastomeric piece comprises a flat cylinder provided in the central region of the distal surface with a plurality of flexible distal radial tentacles capable of deflecting proximally, each tentacle facing a radial channel, said tentacle closing said radial channel when in a non-deflected state, and leaving said radial channel open when in a deflected state.

3. The adaptor of claim 1, wherein the gripping member is an axial clipping member capable of being axially mounted on the collar of said medical container.

4. The adaptor of claim 3, wherein the axial clipping member comprises a deflecting skirt capable of being axially engaged on said collar, said deflecting skirt extending from said transversal wall in a distal direction.

5. The adaptor of claim 1, further comprising an indicator system for informing the user about which through hole, out of said plurality of through holes, said opening is aligned with.

6. The adaptor of claim 5, wherein said selecting member comprises a tubular wall receiving a lateral wall of said intermediate piece, the indicator system comprises a window provided on said tubular wall of said selecting member, said window facing different information data located on said lateral wall of said intermediate piece each time said opening is aligned with a new through hole after rotation of the selecting member with respect to said intermediate piece.

7. The adaptor of claim 1, wherein the pierceable elastomeric piece is self-resealing.

8. The adaptor of claim 1, wherein the pierceable elastomeric piece is made of a material selected from synthetic polyisoprene, natural rubber, silicone rubber, thermo-plastic elastomers and combinations thereof.

9. The adaptor of claim 1, further comprising a blister surrounding said adaptor in a storage state.

10. An assembly comprising a medical container having a collar closed by a septum, said septum having an outer surface directed towards an outside of the medical container, and an adaptor according to claim 1.

* * * * *